US006880820B2

(12) United States Patent
Dobrindt et al.

(10) Patent No.: US 6,880,820 B2
(45) Date of Patent: Apr. 19, 2005

(54) CONVEYOR ROLLER DEVICE FOR DEPOSITING SHEETS ON A STACK

(75) Inventors: Dirk Dobrindt, Klausdorf/Schwentine (DE); Lutz Rebetge, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 176 days.

(21) Appl. No.: 10/315,701

(22) Filed: Dec. 10, 2002

(65) Prior Publication Data

US 2003/0178766 A1 Sep. 25, 2003

(30) Foreign Application Priority Data

Dec. 10, 2001 (DE) ..... 101 60 382

(51) Int. Cl.[7] ..... B65H 29/22
(52) U.S. Cl. ..... 271/81; 271/314
(58) Field of Search ..... 271/81, 107, 314, 271/272, 275

(56) References Cited

U.S. PATENT DOCUMENTS 4,884,909 A * 12/1989 Watanabe et al. ..... 400/625

FOREIGN PATENT DOCUMENTS

DE 199 57 574 A1 9/2000 ..... B65H/29/22

* cited by examiner

*Primary Examiner*—Donald P. Walsh
*Assistant Examiner*—Kaitlin Joerger
(74) *Attorney, Agent, or Firm*—Lawrence P. Kessler

(57) ABSTRACT

A device for conveying and depositing paper on at least one stack, with a device (27) for moving conveyor rollers (1) laterally in the conveying direction of the sheets and a device (28) for transmitting rotations to conveyor rollers (1), in particular to operate within a depositing device of a sheet-processing machine. In order to ensure a quicker lateral movement of conveyor rollers (1) and to protect the devices (27) and (28) from soiling and mechanical effects, members of the same are located within a rod (2), on which conveyor rollers (1) are located. Furthermore, there are possibilities to calibrate the device with respect to the position of conveyor rollers (1) and to adjust height differences within a stack with tensionless equalization.

6 Claims, 5 Drawing Sheets

CONVEYOR ROLLER DEVICE FOR DEPOSITING SHEETS ON A STACK

FIELD OF THE INVENTION

The invention relates to a device for conveying and depositing sheets on at least one stack, with a device for moving the conveyor roller laterally in the conveying direction of the sheets and equipment for the transfer of rotation to the conveyor roller, in particular for operating within a depositing device of a machine for processing sheets, in particular a digital multicolor printing press.

BACKGROUND OF THE INVENTION

In paper processing machines, in particular in multicolored printing presses, subassemblies are used at the end of the paper path as an extension arm that controls the depositing paper sheets on an already existing stack or which can build a new stack. To this end, there are systems, for example, that work with negative pressure and overpressure, or which operate, in a purely mechanical way, e.g., by tappets and holding down systems with rollers located above. Such mechanical systems, as describe in the publication of disclosure of patent DE 199 57 574 A1, make it possible to deposit sheets with a very high degree of precision. Fewer material-intensive members are used than with customary extension arms, whereby sufficient space is available in the area around the stack to remove the stack, to inspect it or to further process the sheets.

In the extension arm described in the patent DE 199 57 574 A1, a last pair of rollers in the paper path in particular is used as a conveyor roller pair, which is attached above a pair of tappets and a hold down device. The function of this conveyor roller pair is used in conjunction with the pair of tappets and the holding down device to deposit sheets conveyed in the area of the extension arm that fit perfectly on a paper stack or to build a new stack.

The transport roller pair can be moved by rotation and can be laterally moved in the conveying direction of the sheet. The surface of the conveyor roller has a very high friction value, while the tappets located directly below the conveyor rollers on their side facing the rollers have a very low friction value. The lateral mobility of the conveyor rollers makes it possible to correct any misalignment of a sheet, at least in its position transverse to the conveying direction. Furthermore, the lateral position of sheets on a stack can be controlled, so that, for example, offsets for differentiating between the various printing jobs within the stack can be produced.

The sheets are quickly conveyed to the stack by rotating rollers. The transfer of the rotation to the conveying rollers takes place by a drive shaft. The rollers are attached to an aluminum pipe that is connected to the drive shaft. The drive shaft can then be driven by a toothed belt.

For the lateral movement of the conveyor roller in DE 199 57 574 A1, an actuator is provided above the conveyor rollers, which drives a spindle. In order to prevent twisting, a swivel head is fastened to a spindle, which drives a rod. The rod is screwed into a non-rotating adjusting ring on the aluminum pipe of the conveyor rollers. The adjusting ring is transversely coupled to the conveyor rollers, which makes it possible to move the conveyor rollers laterally.

The rod drives the swivel head on the spindle by an opening. When a new piece of paper is to be deposited on the stack, it is necessary that the conveyor rollers be removed from the surface of the stack, for which lever arms are provided on the drive shaft.

The speed with which the conveyor rollers can be laterally moved is limited here. It can be increased, for example, via a spindle that has a larger spindle stroke. However, such an extension of the system would entail substantial cost increases.

The spindle, which effects the lateral movement of the conveyor rollers, is shown here open and unprotected. As a result, it is easily soiled, and it is also susceptible to mechanical effects. Consequently, it may be damaged or at least its function may be impaired.

The drive shaft for transferring the rotation to the conveyor rollers may be driven by means of a toothed belt. Since there may be a difference in height between the sides of the sheet stack, a tilt of the drive shaft may also be required via the conveyor rollers. This tilt may amount to 4°. Since the wheels of the tooth belt are rigidly connected with the drive shaft, this tilt is also transmitted to the flanged rim pulleys of the toothed belt wheels. As a result, the toothed belts are pushed to the edge of the flanged rim pulleys and are constantly rubbed by the tilting position. Due to the wear and tear of the toothed belt, they have to be changed often.

SUMMARY OF THE INVENTION

The basic task of the invention is to cost effectively raise the speed with which the conveyor rollers are laterally moved in the conveying direction of the sheets. In addition, a protection of the spindle against soiling and external, undesired mechanical effects and/or damages is also achieved. Furthermore, the intervals in which the toothed belt wheels have to be changed due to wear and tear is extended.

The task is solved according to the invention, whereby members of the device for the lateral movement of the conveyor rollers and members of the device for the transfer of rotation are located in a pipe to which the conveyor rollers are attached.

The conveyor rollers are securely attached to a rod, according to the invention. This rod is connected with two lever arms in such a way that the rod can rotate freely and can be moved laterally. The rod with the conveyor rollers can be vertically lifted by the lever arms, which is necessary when adding new sheets to the stack. The advantage of this arrangement is that the rod within the holder can rotate, since the latter is not hindered by the lever arms. As a result, lateral movements of the rod and thus of the conveyor rollers are possible that are not impaired by the holder. Since the conveyor rollers in this embodiment of the invention are directly connected with the rod, they can also be lifted vertically, without another member having to be connected between them.

According to the invention, the device is such that members for the transfer of the rotation to the conveyor rollers are located within the rod. They contain a drive shaft, which is arranged on the side of the rod and which is form-fitted with the rod. The drive shaft can be driven with the coupled rod and it can be moved rotationally, so that, in addition, a torque can be transmitted to the conveyor rollers. In this manner, the driving mechanism of the conveyor rollers is located compactly within the rod. In addition, it is not necessary for the drive shaft to have the entire width of the extension arm. The production of the extension arm thus requires less material. Furthermore, the other end of the rod remains free, so that members for other devices can be fitted here. It is also possible that each conveyor roller be individually driven by separate drive shafts. As a result, it can be guaranteed that the conveyor rollers can rotate at different speeds. Different rotational speeds of the rollers can be used advantageously to correct the position of the sheets. If the drive shaft does not pass through between the two conveyor rollers, the rotating axes of the rollers can also adopt different angles to each other, but they must not run parallel to each other. Other correcting possibilities for the sheet position are thus provided. The sheets can also be accessed more easily from the top, since a limiting member is omitted. Furthermore, sources of error are omitted, since fewer wear and tear parts are involved in the transmission of rotation. Since the drive shaft now lies completely within the rod, it is no longer exposed to soiling and potential sources of malfunction.

Advantageously, it is further provided according to the invention, that the drive shaft not be directly connected with the rod. A carrier is provided for this purpose, whose connection is perfectly fitted with the drive shaft and the rod. The carrier can be freely moved on the drive shaft and/or the inside of the rod. For this purpose, both the drive shaft as well as the inside of the rod have a suitably adjusted shape.

The carrier can be adjusted or press-fitted into the rod or into the drive in such a way that, with regard to an interconnecting point between the drive shaft and rod, it can no longer be moved horizontally; as a result, friction points can advantageously be avoided and the stability of the system consisting of a drive shaft, carrier and rod, increases. First, the horizontally freedom of movement of the carrier on at least one of the surfaces, inside the rod or the top surface of the drive shaft, is guaranteed, so that the rod can be laterally moved. Only in this fashion can the rollers also be laterally adjusted for positioning of the sheets. The drive shaft transmits the rotation to the conveyor rollers via the carrier; the most favorable condition for this is when one side of the carrier is anchored. According to the invention, it is thus envisaged to anchor the carrier to the inside of the rod. The carrier is connected with the drive shaft for rotation and disconnected for later movements.

In accordance with the device, the task of the invention is further solved in such a way that the members of the device for lateral movement of the conveyor rollers are located inside the rod. It is thus provided that in the other end of the rod opposite the device for the transmission of rotation, there is a spindle with a ball screw nut attached to it. The ball screw nut is connected with the rod in such a way that it is completely disconnected for rotation. To this end, in accordance with the device, a connection between the ball screw nut and rod in the form of bearings is provided. Furthermore, the ball screw nut is coupled to the rod for lateral movements. According to the invention, these couplings can take place via the bearings, which provide a rotational disconnection of the ball screw nut from the rod. It is provided that the ball screw nut can be connected perfectly form-fitted with the bearings, so that lateral movements of the ball screw nut can be directly transmitted to the bearings and thus to the rod as well. In this manner, a considerably precise control of the conveyor rollers can thus take place, since with the perfectly fitted attachment of the ball screw nut provided here, it can thus be attached between two bearings, so that practically no more play exists. In this embodiment of the invention, the spindle lies inside the rod and it is thus protected from soiling and mechanical loads. As a result, fewer damages and malfunctions of the spindle occur. Since the spindle here effects the lateral movement of the rod, a higher speed of the lateral movement can easily be reached via an increased r.p.m. Here, no additional members are involved in the transmission of movement, which would malfunction under an increased speed, and even the drive itself is not a limiting member here.

Advantageously, it is provided in the invention that the lever arms are connected with the rod via swivel heads. Preferably, the swivel heads should be located in the area around the end of the rod. In this way, it is possible to disconnect the lever arms by tipping the rod. Tipping thus always occurs when the stack has a difference in height between various points of its surface. The conveyor rollers lie temporarily on the stack during the sheet depositing process. In this way, its tilting is directly transmitted to the rod. Since the lever arms are disconnected via the swivel heads from the rod during the tilting, favorably fewer shear forces are exerted on the lever arms.

According to the invention, it is provided that both the drive shaft, as well as the spindle, is connected with drive members via cardan (universal) joints. These cardan joints should advantageously be concentric to the swivel heads on the axis of the rod. In this way, it is ensured that the tilting of the conveyor rollers is not transmitted to the lever arms or to the drive members, the drive shaft and the spindle. The driver members should be connected with the lever arms via bearings; there should be no direct connection with the rod. The drive members should be either rotational via the drive shafts and bearings, or disconnected from the rod for lateral movements. According to the invention, toothed belts can be provided, which transmit the force to the drive members in the form of toothed belt wheels. The tooth belt wheels are provided with flanged rim pulleys, which the toothed belts surround laterally. By tipping the toothed belt wheels relative to the toothed belts, the toothed belts run down the flanged rim pulleys and are thus worn out.

This tipping can thus be avoided by the cardan joints and, as a result, the service life of the toothed belts can be extended. The same also applies for other driving systems, such as geared wheels.

In a further expansion of the invented device, at least one position-locating unit, to identify the position of the rod, in particular the position of the conveyor rollers, at least one side of the rod is provided. It can be provided in the area surrounding a swivel head, preferably on a lever arm. The position-locating unit can preferably include a fork light barrier on the lever arm and a disk, which is located on the rod. This position-locating unit can fulfill two functions. It can prevent the rod from being moved so far that a swivel head, a drive member or other members of the device within the toothed belt wheel are damaged or destroyed. The disk is anchored in a fixed position on the rod. This position is chosen so that the disk then immediately releases the fork light barrier if the lateral movement of the rod exceeds a maximum. In accordance with the device, two position-locating units are provided at each end of the rod.

In a second embodiment, the position-locating unit can be used to calibrate the position of the conveyor rollers. In this case, only a position-locating unit is required. Since the distance of the disk to the rod of the conveyor rollers is constant and known, by detecting the position of the disk, the position of the conveyor rollers can be directly concluded. This is advantageous in order to ensure the highest depositing of the sheets on the stack.

BRIEF DESCRIPTION OF THE DRAWINGS

Embodiments, which are able to provide further characteristics of the invention, but to which the invention is not limited in scope, are illustrated in the drawings in which.

DETAILED DESCRIPTION OF THE INVENTION

Figure 1:
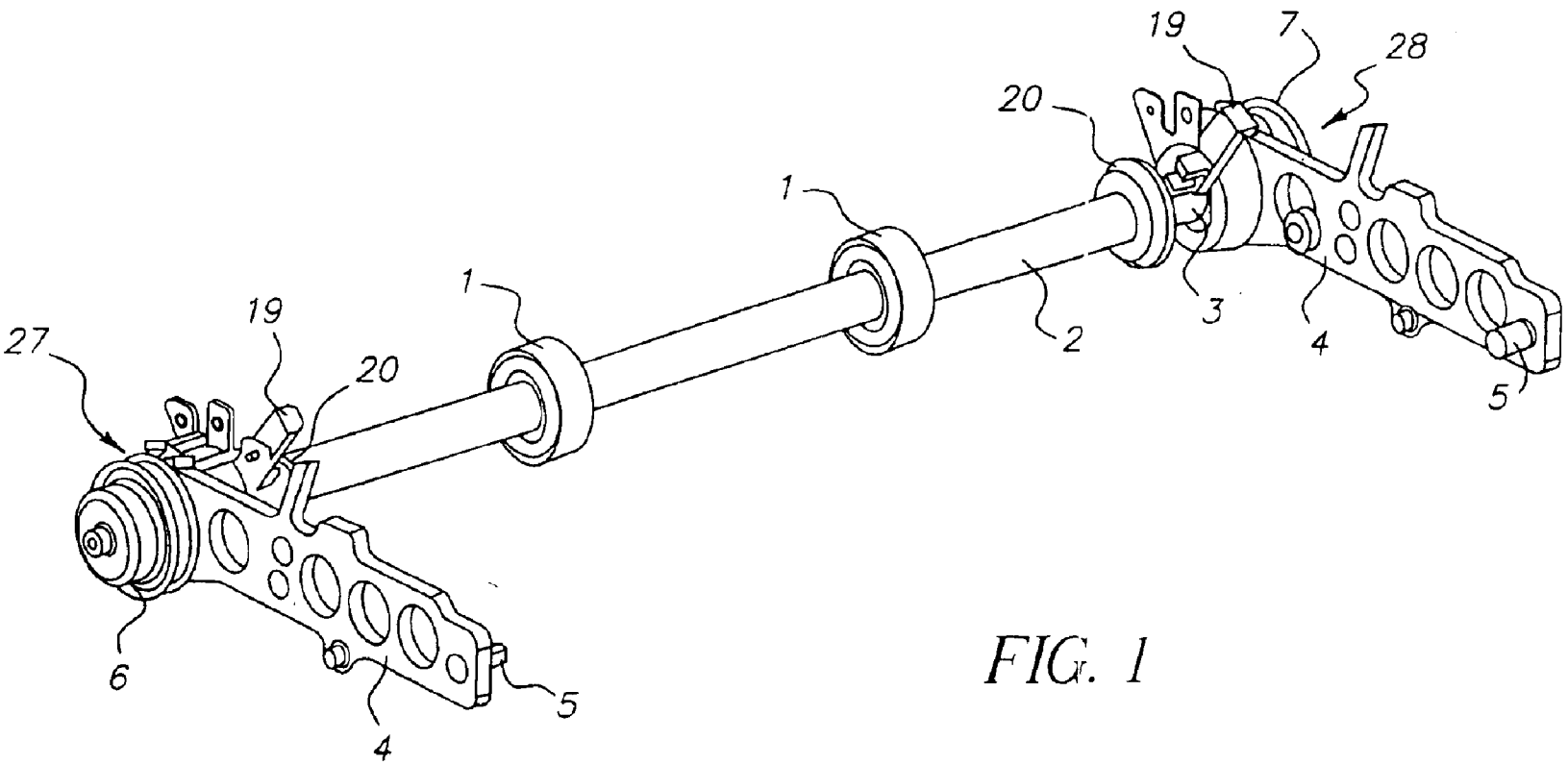
FIG. 1 is a device, according to the invention, for conveying and depositing sheets on a stack.

FIG. 1 shows a top view of a device for the conveying and depositing of sheets on a stack. Conveyor rollers 1 are securely anchored to a rod 2. This rod is supported by two swivel heads 3 on lever arms 4. Lever arms 4 are connected rotationally with a partially illustrated housing via pivot points 5. Toothed wheels 6 and 7 are located on the ends of rod 2. A position-locating unit is illustrated, which consists of a fork light barrier 19 surrounding lever arms 4 and two disks 20 at the end of rod 2. The conveyor rollers 1 are located on rod 2 in such a way that they form a right angle. The ends of rod 2 hold a device 27 for lateral movement and a device 28 for transmitting a rotation to the conveyor rollers 1.

Figure 2:
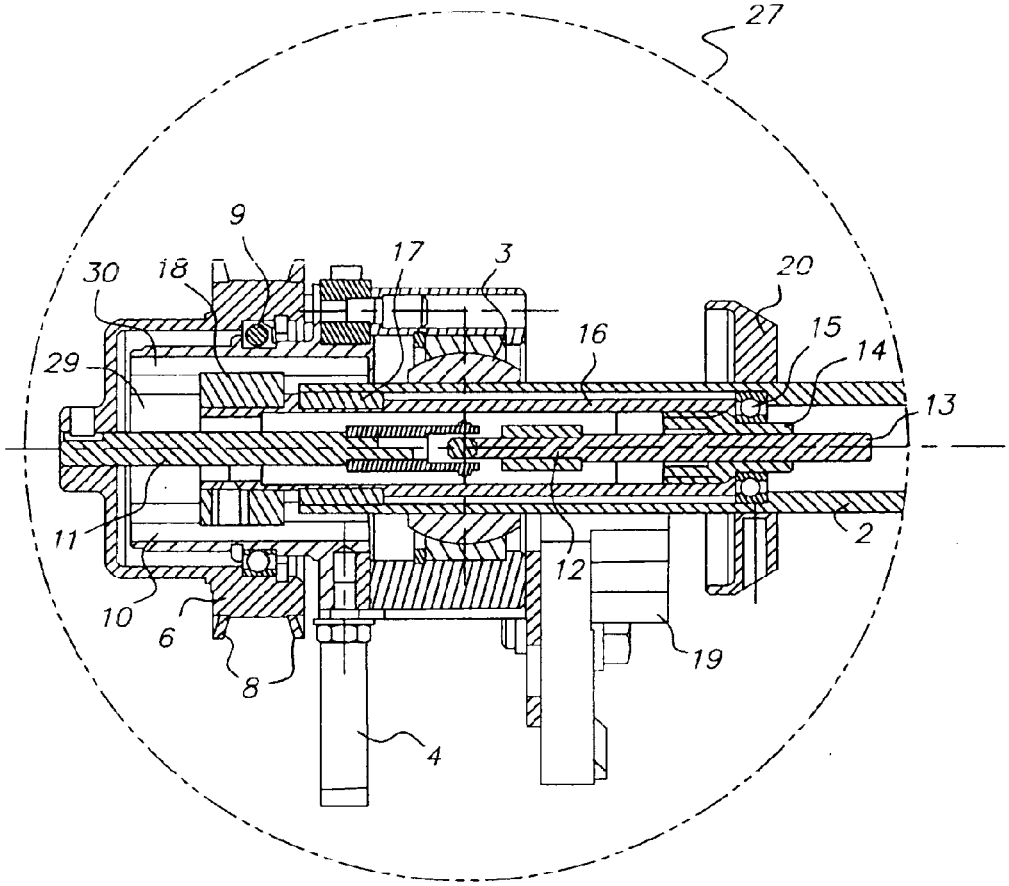
FIG. 2 is a device for the lateral movement of conveyer rollers.

FIG. 2 illustrates an enlargement of the area in FIG. 1, in which the device 27 for the lateral movement of conveyor rollers 1 is illustrated. Rod 2 is supported by a swivel head 3 on lever arm 4. Lever arm 4 is connected by means of a ball bearing 9 with toothed belt wheel 6 via a sleeve 10. The toothed belt wheel 6 has flanged rim pulleys 8 (not shown) for guiding toothed belts provided for driving. Via the toothed belt wheel 6, a rotation can be transmitted to a drive shaft 1, which is connected with a spindle 13 by a cardan joint 12. The center point of the cardan joint coincides with the center point of the swivel head 3. On spindle 13, a ball screw nut 14 is positioned, which is disconnected by a ball bearing 15 of rod 2 during rotations. The ball screw nut 14 is connected to a sleeve 16, which encloses spindle 13, cardan joint 12 and drive shaft 11. This sleeve 16 is supported inside rod 2 on a sleeve bearing 17 that has been press-fitted into rod 2 and is thus disconnected from rod 2 rotationally. Rod 2 terminates with the sliding bearing and does not surround the entire sleeve 16. At the end of sleeve 16, there is a clamping block 18, which has a wrench opening across flats and which, in addition, is secured to sleeve 10 so that it cannot twist. Free spaces 29 and 30 for the clamping block and sleeve 16 are recessed within sleeve 10. Furthermore, positioned on lever arm 4 is a fork light barrier 19, which can be released by the disk 20 on rod 2.

Figure 3:
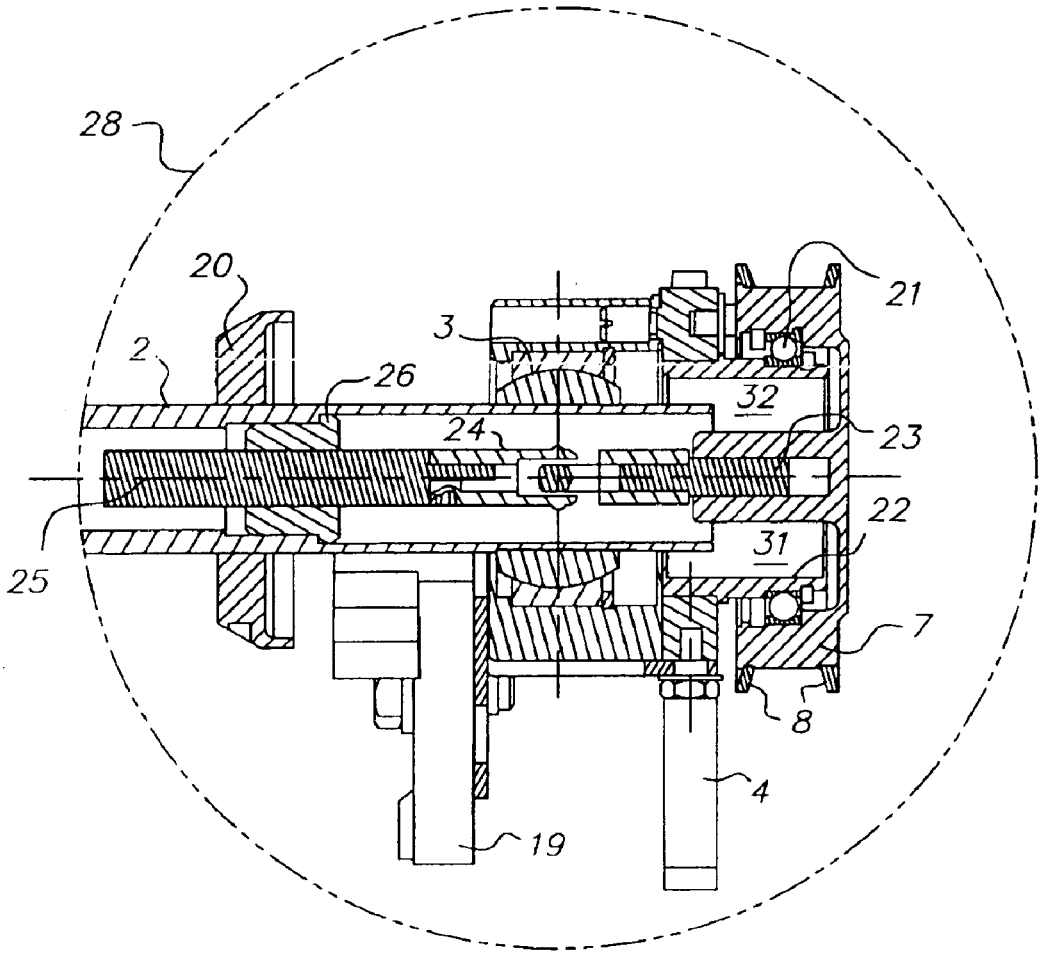
FIG. 3 is a device for the transmission of rotation to conveyor rollers.

FIG. 3 shows an enlargement of Area B in FIG. 2. Members of the device 28 for the transmission of rotation to conveyor rollers 1 in which the device 28 for transmitting rotation of conveyor rollers is illustrated therein. The toothed belt wheel 7 is also supported herein by a ball bearing 21 on a sleeve 22. This sleeve 22 is connected with lever arm 4. Flanged rim pulleys 8 are also located on this toothed belt wheel 7 for guiding toothed belts that are not shown. Via the toothed belt wheel 7, a drive shaft 23 is driven, which is connected via a cardan joint 24 with a drive shaft 25. The center of the flanged rim pulley coincides with the center point of swivel head 3, which is connected with lever arm 4. The drive shaft is connected with the lever arm via a carrier 26. Rod 2 has a corresponding fit, so that the carrier 26 is connected with rod 2 so that it cannot twist. The carrier 26 is thus connected with rod 2 via a wrench opening across flats. Free spaces 31 and 32 for rod 2 are recessed within sleeve 22. On lever arm 4, a fork light barrier 19 is positioned, which, with a disk 20, which is attached to rod 2, can verify the position of rod 2.

Figure 4:
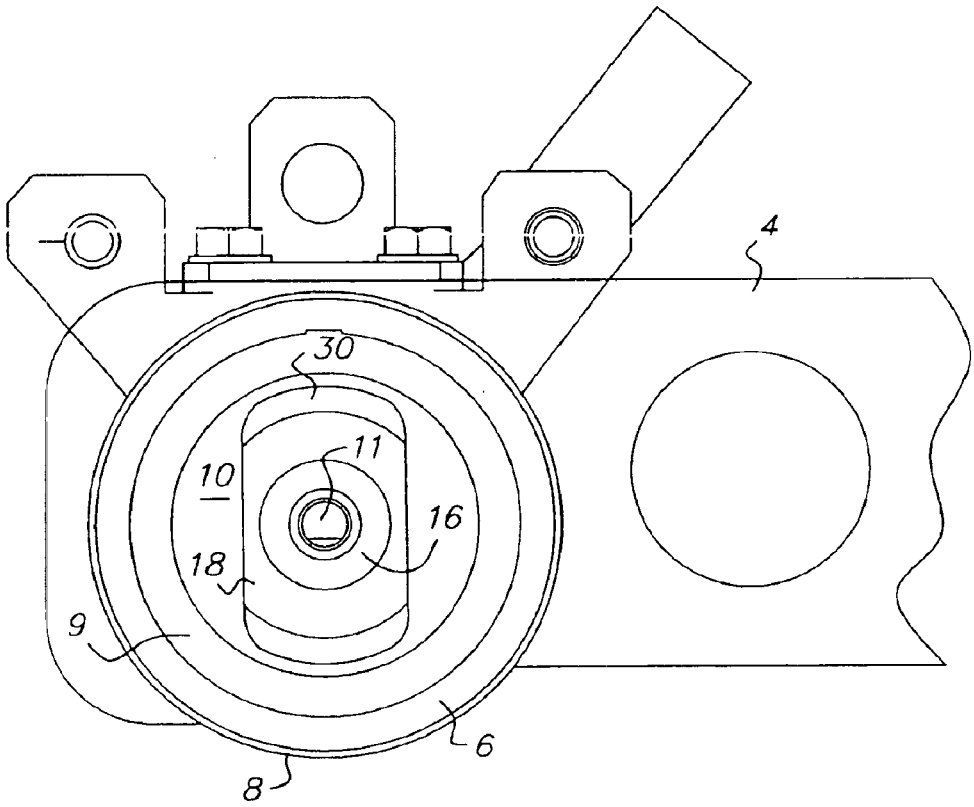
FIG. 4 shows a connection between a driving member with members of the device for the lateral movement of conveyor rollers according to FIG. 3.

FIG. 4 shows a cross-section of the toothed belt wheel 6, in which the members of the device 27 for lateral movement of conveyor rollers 1 can be seen. Clamping block 18 is attached to the sleeve 16, through whose axis drive shaft 11 is located. The clamping block 18 is configured as a dihedron, and sleeve 10 has a corresponding shape, so that a movement of the clamping block 18 is only possible in the direction of the free space 30. It is not possible to turn clamping block 18. As a result, the spindle connected with clamping block 18 via ball screw nut 15 and sleeve 16 is secured against twisting or rotating.

Figure 5:
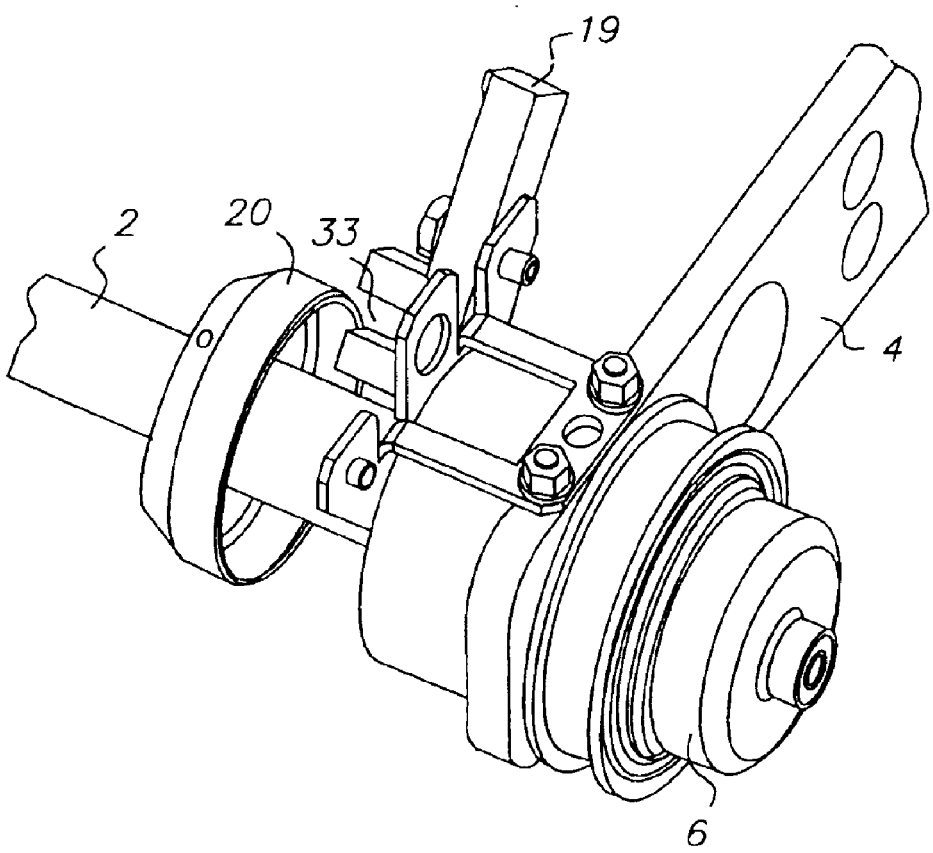
FIG. 5 is a position-locating unit.

FIG. 5 illustrates a top view of the tilted top at the end of rod 2, so that a position-locating unit can be seen. The fork light barrier 19 is securely mounted on lever arm 4. The shape of the disk, which is located on rod 2, is configured in such a way that from a certain position of rod 2, an outer rim of disk 20 is inserted into the opening 33 of fork light barrier 19.

With the configuration, as shown in FIG. 1, sheets can be deposited on a stack. Conveyor rollers 1 turn together with rod 2 around a common axis. The sheets can be conveyed in this manner, since the surfaces of conveyor rollers 1 have a high friction value. The transmission of the rotation to rod 2 takes place via the toothed belt wheel 7. In order to convey a sheet in the conveying direction, the sheet lies on the surface of the stack, whereby tappets (not shown) are located between sheets and stack. Conveyor rollers 1 lie thereby on the sheet. For the tappets to be removed, conveyor rollers 1 must be lifted. To this end, rod 2 is lifted by lever arms 4. The lever arms 4 are therefore connected with pivot points 5 with a housing (not shown) and can thus be vertically lifted. In this position, the sheet, supported by a holding down system (also not shown) is anchored to the stack. In order to convey a new sheet to the stack, conveyor rollers 1 are lowered on the new sheet in such a way that the sheet is set between conveyor rollers 1 and the stack. If the lateral position of the sheet is not that desired, which may also be the case, for example, if distance is created within the stack, there is thus the possibility that conveyor rollers 1 can laterally move the sheet, so that the desired position is taken. For this purpose, it is possible, according to the configuration of the invention shown, to move rod 2 laterally between the two lever arms 4. The device 27, configured for laterally moving rod 2, is driven by the toothed belt wheel 6.

In order to ensure an exact lateral movement of a sheet and to pile up a stack in a desired position perpendicular to the sheet conveying device, the absolute position of conveyor rollers 1 must be determined. To this end, a position-locating unit, consisting of a fork light barrier 19 and a disk 20, which is anchored to rod 2, is located at the end of rod 2. Before the sheet can be conveyed, the absolute position of the conveyor rollers is determined via this position-locating unit and device 27 for lateral movements of the conveyor rollers 1 is calibrated with this unit. For this purpose, rod 2 is laterally moved so far, that the outer rim of disk 20 is driven through the fork light barrier 19. As a result, a signal is given, so that the position of disk 20 is now known. Since the distance between conveyor rollers 1 and disk 20 cannot be changed, the result is that now the position of conveyor rollers 1 can be precisely determined. This knowledge can be used by control electronics, which is not shown here, to deposit the sheet as targeted and precisely lateral to its conveying direction.

A second position-locating unit, consisting of a fork light barrier 19 and a disk 2, is also located on rod 2. This unit, in cooperation with the first position-locating unit, is used to prevent rod 2 from being moved too far, which would lead to a destruction of members within a toothed belt wheel 6 or 7 or which would lead to the lateral movement of conveyor rollers 1 or to the transmission of rotation to the conveyor rollers 1 by members of one of the devices 27 or 28. Since rod 2 is inserted up to the toothed belt wheels 6 and 7, a lateral movement of rod 2 beyond a maximum must be avoided. Disks 20 are thus located in positions in rod 2 that are measured in such a way that the respective outer rims of the disks release the fork light barrier 19, if the lateral movement of rod 2 just reaches this maximum.

The lateral movement and the transmission of rotation can be ensured with the members of the device shown in FIGS. 2 and 3. Both device 27 for lateral movement of conveyor rollers 1 as well as device 28 for the transmission of rotation lie within rod 2. The conveyor rollers 1 are thereby located in rod 2, which is moved by devices 27 and 28. As a result, the members of devices 27 and 28 that are located within rod 2 are protected from soiling and external effects. The lever arms 4 are connected with rod via swivel heads 3. As a result, rod 2 can freely rotate and it is laterally moved, as explained above, without being impaired by the position.

The members of the device 27 for lateral movement of the conveyor rollers 1 shown in FIG. 2 ensure that conveyor rollers 1 can be positioned in such a way that the paper conveyed can be deposited on a stack as desired. The conveyor rollers 1 lie on rod 2. The lateral movement is transmitted to rod 2 by a ball screw nut 14. To this end, the ball screw nut 14 is connected with rod 2 via the bearings 15 and 17, whereby the connection with bearing 17 takes place via a sleeve 16 that is attached to the ball screw nut 14. The system composed of ball screw nut 14 and sleeve 16 is so firmly fitted in the space between bearings 17 and 16, that lateral movements of the ball screw nut 14 are directly transmitted to rod 2. Bearing 15 hereby takes the form of a ball bearing and bearing 17 takes the form of a sliding bearing. As result, rod 2 can rotate, without entraining ball screw nut 14. The sleeve 16 is screwed onto ball screw nut 14 in this configuration and is used for the axial anchoring of ball screw nut 14 inside rod 2. On the other hand, it is also possible via both bearings 15 and 17 to better transmit the lateral movement in both directions via both bearings 15 and 17, since one bearing 15 lies at the beginning of ball screw nut 14 and the other bearing 17 is attached to the end of sleeve 16. Sleeve 16 is thus adjusted at this end to the shape of bearing 17. Bearing 17 is firmly inserted in rod 2.

The lateral movement of ball screw nut 14 takes place herein via spindle 13. Spindle 13 is rotated via cardan joint 12 and drive shaft 11. The transmission of the rotation takes place externally by the toothed belt wheel 6, which is driven by a toothed belt (not shown in greater detail), which should lie between the flanged rim pulleys. In this manner, a lateral movement of rod 2 can be achieved by an external actuation via a toothed belt.

For further anchoring of ball screw nut 14 and sleeve 16, a clamping block 18 is attached to the end of sleeve 16. This clamping block 18 has a wrench opening across flats, as illustrated in FIG. 4. It is more precisely configured as a dihedron. This clamping block 18 is fitted into sleeve 10, so that no lateral movement of sleeve 16 is possible. Sleeve 10 is used herein to connect the toothed belt wheel 6 to lever arm 4 via a ball bearing 9. In order that rod 2 can be moved laterally at least up to a maximum, an empty space 29 inside the toothed belt wheel 6 is provided. In order that rod 2 can also be vertically tipped, without this tipping being transmitted to the toothed belt wheel 6, rod 2 is connected with lever arm 4 with a swivel head 3. There is no direct connection between clamping block 18 and the toothed belt wheel 6. In order to prevent movements between clamping block 18 and sleeve 10, when rod 2 is vertically tipped, a space 30 is envisaged above sleeve 16 and clamping block 18. This makes it possible for rod 2 to be tipped up to a maximum angle provided by an empty space 30, without clamping block 18 or sleeve 16 inside sleeve 11) being aware of it.

It can be seen that the functionality of device 28 for the transmission of rotation to conveyor rollers 1 in FIG. 3 is analogous to FIG. 2. The device is driven by a toothed belt, which runs on the toothed belt wheel 7. The toothed belt is located herein between the flanged rim pulleys 8. The toothed belt wheel 7 lies above the ball bearing 21 on a sleeve 22, which makes the connection with the lever arm 4. The torque is transmitted by the toothed belt wheel 7 to a drive shaft 23. The transmission to the drive shaft 25 then takes place further via a cardan joint 24. The entire drive shaft, including drive shaft 23 to 26, is surrounded by rod 2. The connection of rod 2 with lever arm 4 takes place on this side of rod 2 via a swivel head 3. The cardan joint is located thereby concentrically within swivel head 3. Rod 2 may be tipped by the difference in height of the stack as a result of conveyor rollers 1, which causes a change in the angle of rod 2 with respect to lever arm 4. Since rod 2 is not directly connected to the toothed belt wheel 7, the slanting is not transmitted to the toothed belt wheel 7. The toothed belt wheel 7 is thus always parallel to lever arm 4 and thus aligned with the running direction of the toothed belt. As a result, increased wear and tear of the toothed belt does not occur, since the latter does not run on the flanged rim pulleys 8, which would otherwise be the case.

Drive shaft 25 has a wrench opening across flats, which is synchronized on a carrier 26. This carrier 26 thus can not be twisted with regard to drive shaft 25, but it can be freely moved laterally on drive shaft 25. On the other hand, the carrier 26 is also connected with rod 2, which has a corresponding fit, in such a way that it cannot be twisted. The carrier 26 cannot be freely moved with regard to rod 2, and thus transfers a rotating movement of drive shaft 25 directly to rod 2. On the other hand rod 2 can also be moved freely laterally, without this movement being transferred to drive shaft 25, since carrier 26 can slide freely in this direction on drive shaft 25. Also, in order to prevent the lateral movement of rod 2 from damaging any members inside the toothed belt wheel 7, an empty space 31 in the longitudinal direction within sleeve 22 is provided. Another empty space 32 is located above rod 2 within toothed belt wheel 7 between rod 2 and sleeve 22, so that rod 2 can also tip without doing any damage. In this way, conveyor rollers 1 can be laterally moved and adjusted to the difference in height of the stack, without damaging toothed belt wheel 7 and without heavy wear and tear on the toothed belt.

Another protection from the lateral movement of rod 2 and for calibration of the lateral movement of conveyor rollers 1 is provided by the position-locating unit, including fork light barrier 19 and disk 20. The exact functionality has already been explained with regard to FIG. 1.

FIG. 4 shows how the members of device 27 for lateral movement of conveyor rollers 1 are fitted inside sleeve 10, so that they cannot twist. Drive shaft 11 is located inside sleeve 16. There is an empty space 30 between sleeve 16 and drive shaft 11 that is sufficient, that sleeve 16 in relation to drive shaft 11 with respect to a slanting of rod 2 can be sufficiently tipped. Sleeve 16 is directly connected with ball screw nut 14 and is stabilized via clamping block 18 within sleeve 10 and thus is stabilized in toothed belt wheel 6. Clamping block 18 is thus configured as a dihedron, whereby sleeve 10 surrounding it also has a corresponding shape. Furthermore, an empty space 30 between clamping block 18 and sleeve 10 is available so that clamping block 18 within sleeve 10 can tip in correlation to the position of conveyor rollers 1. The empty space 30 is configured in such a way that rod 2, which has already been connected with clamping block 18 via sleeve 16, can only be tipped at one level.

It can be seen more precisely in FIG. 5 how the position-locating unit functions. Disk 20 is directly connected with rod 2. A lateral movement of rod 2 thus has a direct effect on disk 2, whose rim is inserted with a certain movement in the opening 33 of fork light barrier 19. The position of disk 20 can thus be detected. Since the distance between disk 20 and conveyor rollers 1 is determined, in exactly the same way, the position of the ends (not shown) of rod 2 within the toothed belt wheels 6 and 7 can be determined. This information can thus be further used to calibrate the position of the conveyor rollers 1, or another lateral movement of conveyor rollers 1 can be prevented from exceeding a maximum, which would cause damage within toothed belt wheels 6 and 7 by rod 2.

The invention has been described in detail with particular reference to certain preferred embodiments thereof, but it will be understood that variations and modifications can be effected within the spirit and scope of the invention.

What is claimed is:

1. Device having conveyor rollers (1) for conveying and depositing sheets on at least one stack, with a device for moving conveyor rollers (1) laterally in the conveying direction of the sheets and a device for transmitting rotation to conveyor rollers (1), in particular for operation within a depositing device of a sheet-processing machine, in particular of a digital multicolored printing machine, said conveying device comprising: a device for lateral movement of conveyor rollers (1) including a rod (2) and a drive shaft (25) connected with a laterally freely moveable carrier (26), located on the inside of rod (2), which, with respect to a rotational movement, is coupled both to said rod (2) as well as drive shaft (25), whereby both said rod (2) as well as said drive shaft (25) have a corresponding fit for the carrier (26), and said device for transmitting rotation, including said drive shaft (25) can be driven and is connected in a form-fitted manner said rod (2), to which conveyor rollers (1) are attached.

2. Device according to claim 1, wherein said rod (2) is connected with lever arms (4) in such a way that it can be rotated and laterally moved.

3. Device according to claim 1, wherein an internal ball screw nut (14), lying at one end of rod (2) on a spindle (13), can be rotationally disconnected from rod (2) via bearings (15)(17) and which is coupled with rod (2) via said bearings (15)(17) for lateral movement.

4. Device according to claim 1, wherein said rod (2) is connected with lever arms (4) in the space around the end of rod (2).

5. Device according to claim 3, wherein said drive shaft (25) and said spindle (13) are respectively connected with cardan joints (24)(12), that concentrically lie inside a swivel head (3) and which is are connected with each drive member.

6. Device according to claim 1, wherein at least one position-locating unit for said rod (2) includes a fork light barrier (19) and appropriate disks (20) located on rod (2), and at least one side of rod (2) in the area around a swivel head (3), on a lever arm (4) is available.

* * * * *